US009045299B2

(12) United States Patent
Edwards et al.

(10) Patent No.: US 9,045,299 B2
(45) Date of Patent: Jun. 2, 2015

(54) STAR WHEEL WITH ADJUSTABLE DIRECTIONAL BIASER

(71) Applicant: Lexmark International, Inc., Lexington, KY (US)

(72) Inventors: Mark Joseph Edwards, Lexington, KY (US); Robert W. Rumford, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 34 days.

(21) Appl. No.: 13/769,730

(22) Filed: Feb. 18, 2013

(65) Prior Publication Data

US 2014/0232778 A1 Aug. 21, 2014

(51) Int. Cl.

| | |
|---|---|
| ***B41J 2/01*** | (2006.01) |
| ***B65H 5/06*** | (2006.01) |
| ***B65H 7/02*** | (2006.01) |
| *B41J 29/38* | (2006.01) |

(52) U.S. Cl.

CPC ..... *B65H 5/062* (2013.01); *B65H 7/02* (2013.01); *B65H 2403/512* (2013.01); *B65H 2404/1115* (2013.01); *B65H 2511/13* (2013.01); *B65H 2515/30* (2013.01); *B65H 2555/13* (2013.01)

(58) Field of Classification Search

CPC ..... G06K 15/16; G06K 13/08; B41J 11/42; B41J 17/02

USPC ..... 347/16, 101–104, 139, 153–154, 347/164–165, 197–198, 215–221, 262, 264

See application file for complete search history.

(56) References Cited

U.S. PATENT DOCUMENTS

| | | | | |
|---|---|---|---|---|
| 5,742,318 | A * | 4/1998 | Miyauchi et al. | 347/134 |
| 5,818,487 | A * | 10/1998 | Yoshimura et al. | 347/104 |
| 6,126,347 | A * | 10/2000 | Sakaino et al. | 400/642 |
| 7,018,034 | B2 * | 3/2006 | Rasmussen et al. | 347/104 |
| 7,036,923 | B2 * | 5/2006 | Takagi et al. | 347/104 |
| 7,063,473 | B2 * | 6/2006 | Ohashi et al. | 400/642 |
| 7,222,849 | B2 * | 5/2007 | Ono | 271/272 |
| 7,367,651 | B2 * | 5/2008 | Kang | 347/43 |
| 7,422,320 | B2 * | 9/2008 | Sugiura | 347/104 |
| 7,722,039 | B2 * | 5/2010 | Shoji et al. | 271/273 |
| 8,639,175 | B2 * | 1/2014 | Goto | 399/406 |
| 2002/0171727 | A1 * | 11/2002 | Kida et al. | 347/104 |

* cited by examiner

*Primary Examiner* — Jannelle M Lebron
*Assistant Examiner* — Jeremy Bishop
(74) *Attorney, Agent, or Firm* — John Victor Pezdek

(57) ABSTRACT

A print media feed system in a inkjet printer, the system has a media feed roll, a star wheel mounted opposing the roll, an adjustable biaser coupled to the star wheel, and a controller coupled to the biaser. The controller varies a magnitude, a direction or a magnitude and direction of a biasing force applied to the star wheel by the biaser. In one form, the biaser comprises a motor driven cam that varies the angular position of a pivotable lever having a star wheel rotatably attached on one end. In another form, a rack and pinion gear assembly is used to vary the biasing force with a star wheel rotatably attached to the rack. In a further form, a solenoid is used to vary the basing force applied to the lever or applied to a star wheel rotatably attached to the end of the shaft of a solenoid.

14 Claims, 7 Drawing Sheets

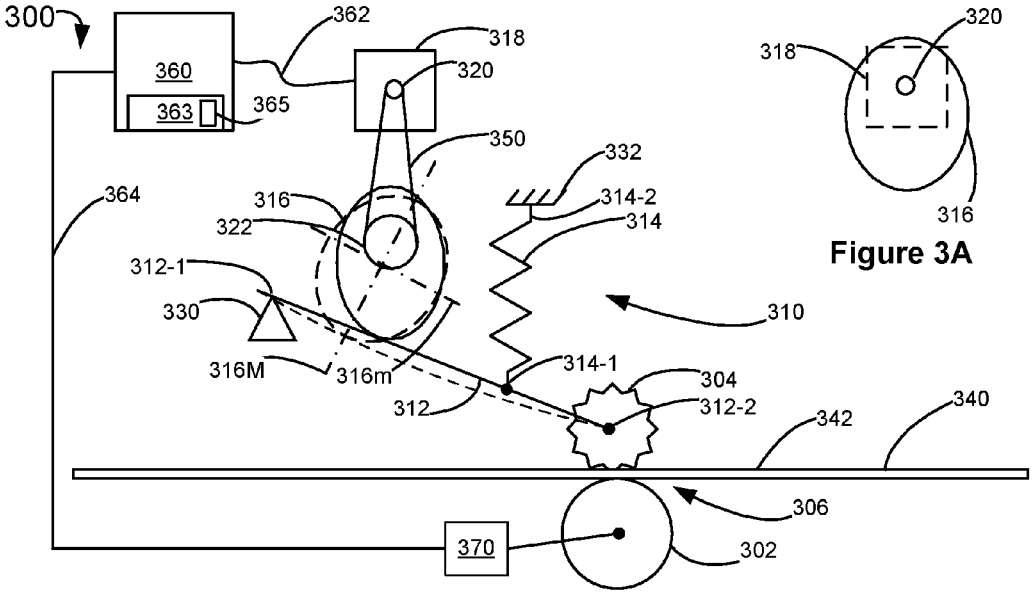
Figure 3A
Figure 3
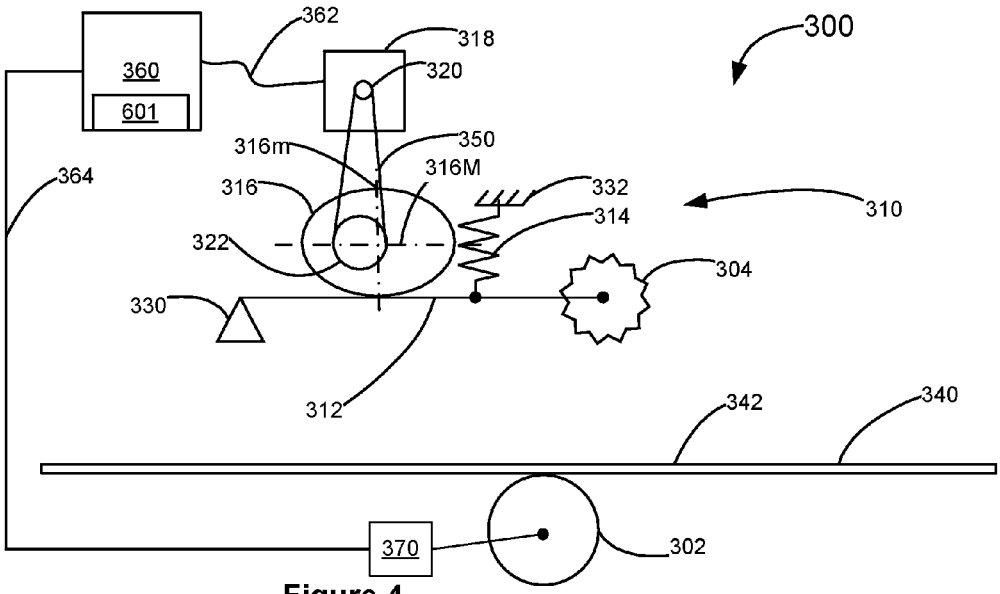
Figure 4

STAR WHEEL WITH ADJUSTABLE DIRECTIONAL BIASER

CROSS REFERENCES TO RELATED APPLICATIONS

The present application is related to U.S. patent application Ser. No. 13/769,588, entitled "METHOD OF USING STAR WHEEL WITH ADJUSTABLE DIRECTIONAL BIASER" filed concurrently herewith and assigned to the assignee of the present application.

STATEMENT REGARDING FEDERALLY SPONSORED RESEARCH OR DEVELOPMENT

None.

REFERENCE TO SEQUENTIAL LISTING, ETC

None.

BACKGROUND

1. Field of the Disclosure

The present disclosure relates generally to media feed systems used in inkjet imaging devices such as inkjet printers or multifunction devices having printing capability and more particularly to a media feed system having a star wheel with adjustable bias.

2. Description of the Related Art

In inkjet imaging device media feed systems, it is now common practice to advance media by pinching the media between a driven media feed roll and one or more star wheels. In simplex printing, the media feed roll touches the non-printed back side of the media and the star wheels touch the printed front side. Star wheels minimize contact with wet ink by minimizing the points of contact with the media. This reduces smearing and other print defects.

In a typical media feed system, star wheels are supported by springs. The springs provide a bias directed toward the media feed rolls. This bias is not adjustable during operation and is not adjusted to optimize the media feed system in response to, for example, different media properties. Also, since the star wheels continuously ride on either media or on rolls, the star wheels may experience excessive wear over the life of the imaging device, especially if the roll is abrasive. Further, the star wheels may become contaminated with ink buildup if they have excessive contact with wet ink. Once contaminated, the star wheels may transfer ink to the media causing print defects.

It would be advantageous to have a media feed system that minimizes these and other shortcomings of typical star-wheel media feed systems.

SUMMARY

The invention, in one form thereof, is directed to a print media feed system in an inkjet printer, the system has a feed roll, a first star wheel mounted opposing the feed roll forming a nip therebetween for receiving a sheet of media, an adjustable biaser coupled to the first star wheel, and a controller in operable communication with the biaser. The controller is configured to adjust the biaser to provide one of a plurality of biasing forces to the star wheel, each of the plurality of biasing forces having a unique magnitude, a unique direction, or a unique magnitude and direction.

The invention, in another form thereof, is directed to a print media feed system in an inkjet printer, the system having a feed roll, a first star wheel mounted opposing the feed roll forming a nip therebetween for receiving a sheet of media, an adjustable directional biaser coupled to the first star wheel, and a controller in operable communication with the biaser. The controller is configured to adjust the biaser to provide in a first position a biasing force to move the star wheel toward the feed roll and in a second position to provide a biasing force to move the star wheel away from the feed roll with the biasing force changing magnitude and direction as the directional biaser moves between the first and second position.

The invention, in yet another form thereof, is directed to a print media feed system in an inkjet printer, the system having a feed roll, a first star wheel mounted opposing the feed roll forming a nip therebetween for receiving a sheet of media, a first lever having a first end pivotally mounted in the inkjet printer and a second end rotatably coupled to the star wheel, a first cam coupleable to a motor, a first biasing member holding the first lever against the first cam, and a controller in operable communication with the motor. The controller is configured to adjust the angular position of the motor which adjusts the angular position of the cam and the first lever to provide one of a plurality of biasing forces to the star wheel, each of the plurality of biasing forces having a unique magnitude, a unique direction, or a unique magnitude and direction.

BRIEF DESCRIPTION OF THE DRAWINGS

The above-mentioned and other features and advantages of the disclosed embodiments, and the manner of attaining them, will become more apparent and will be better understood by reference to the following description of the disclosed embodiments in conjunction with the accompanying drawings.

FIGS. 3 and 4 are schematic diagrams of one example embodiment of a print media feed system having an adjustable biaser. In FIG. 3, the biaser has the star wheel touching the print media, and in FIG. 4, the biaser has lifted the star wheel off of the print media. FIG. 3A illustrates the off-center position of the motor along the major axis of the cam in the adjustable biaser.

DETAILED DESCRIPTION

Figure 1:
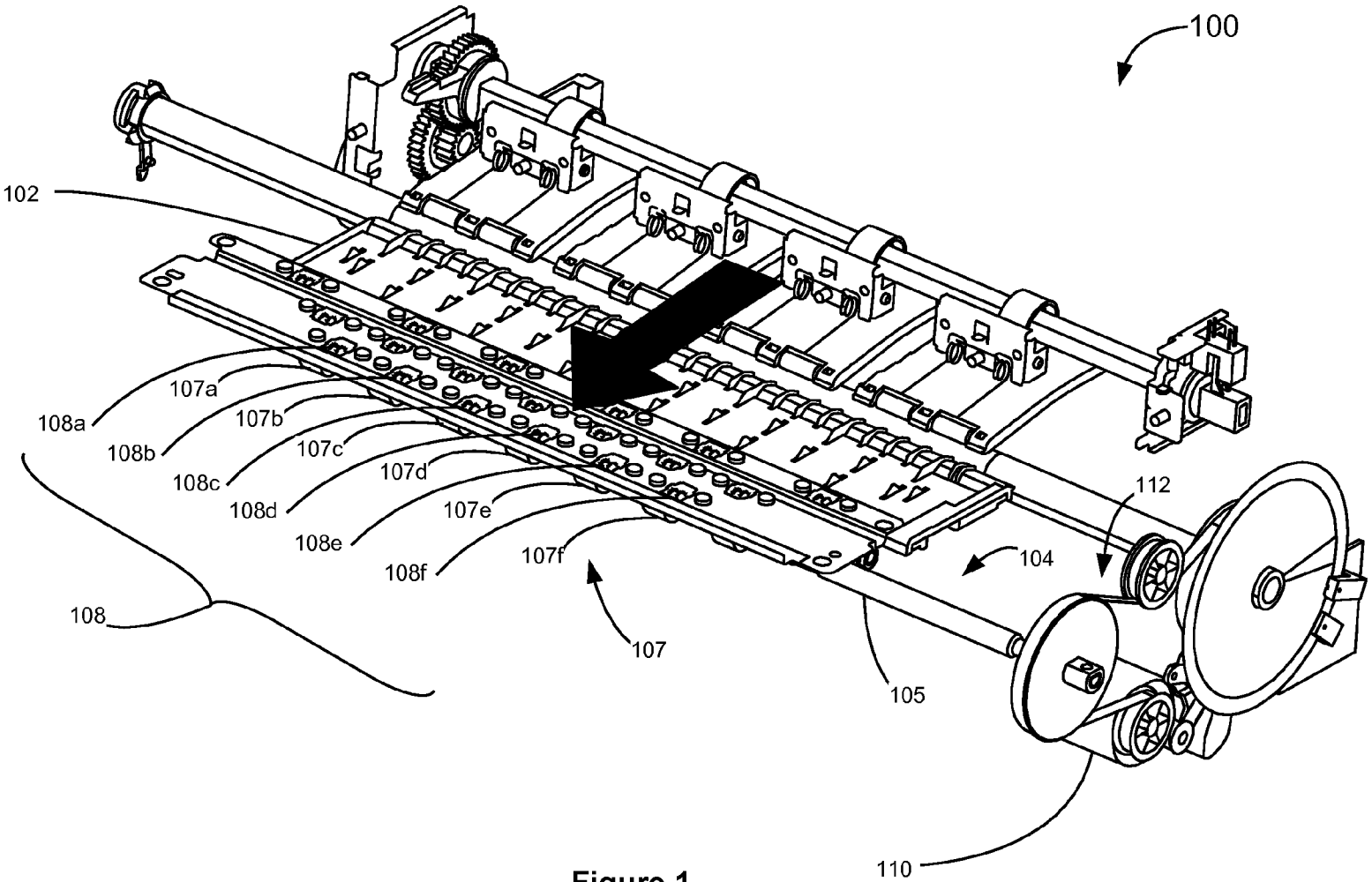
Figure 1 Prior Art
FIG. 1 is a drawing of a prior art print media feed system having star wheels.

It is to be understood that the present disclosure is not limited in its application to the details of construction and the arrangement of components set forth in the following description or illustrated in the drawings. The present disclosure is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Spatially relative terms such as "top", "bottom", "front", "back", "rear" and "side", "under", "below", "lower", "over", "upper", and the like, are used for ease of description to explain the relative positioning of one element to a second element. Terms like "horizontal" and "vertical" are used in a similar relative positioning as illustrated in the figures. These terms are generally used in reference to the position of an element in its intended working position within an imaging device. The terms "left" and "right" are as viewed with respect to the insertion direction of a unit into the imaging device. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description. The articles "a", "an" and "the" are intended to include the plural as well as the singular, unless the context clearly indicates otherwise.

The term "image" as used herein encompasses any printed or digital form of text, graphic, or combination thereof. The term "output", as used herein, encompasses output from any printing device such as color and black-and-white copiers, color and black-and-white printers, and so-called "all-in-one devices" that incorporate multiple functions such as scanning, copying, and printing capabilities in one device. The term "button" as used herein means any component, whether a physical component or graphic user interface icon, that is engaged to initiate a signal such as an input or output signal.

Referring now to the drawings and particularly to FIG. 1, there is shown a drawing of a prior art print media feed system. As shown, the print media feed system 100 includes a media support surface 102 that is upstream of a media feed roll 104 and a plurality of pairs of star wheels, generally designated 108. The media feed direction is indicated by the black arrow. As illustrated, six pairs of star wheels 108*a*-108*f* are provided. The media feed roll 104 has a shaft 105 and a plurality of spaced rolls, generally designated 107, mounted thereon. As shown rolls 107*a*-107*f* are provided and correspond to each pair of the pairs of star wheels 108*a*-108*f* and form a nip therebetween. Media feed roll 104 is driven by a motor 110 via a transmission 112. The plurality of pairs of star wheels 108 press media against the rotating media feed rolls 107 to advance the media through the print media feed system 100. While pairs of stars wheels are illustrated, it is understood by those of ordinary skill in the art that a single star wheel may be used instead. Similarly, rolls 107 may be replaced by a single feed roll spanning all of the pairs of star wheels 106.

Figure 2:
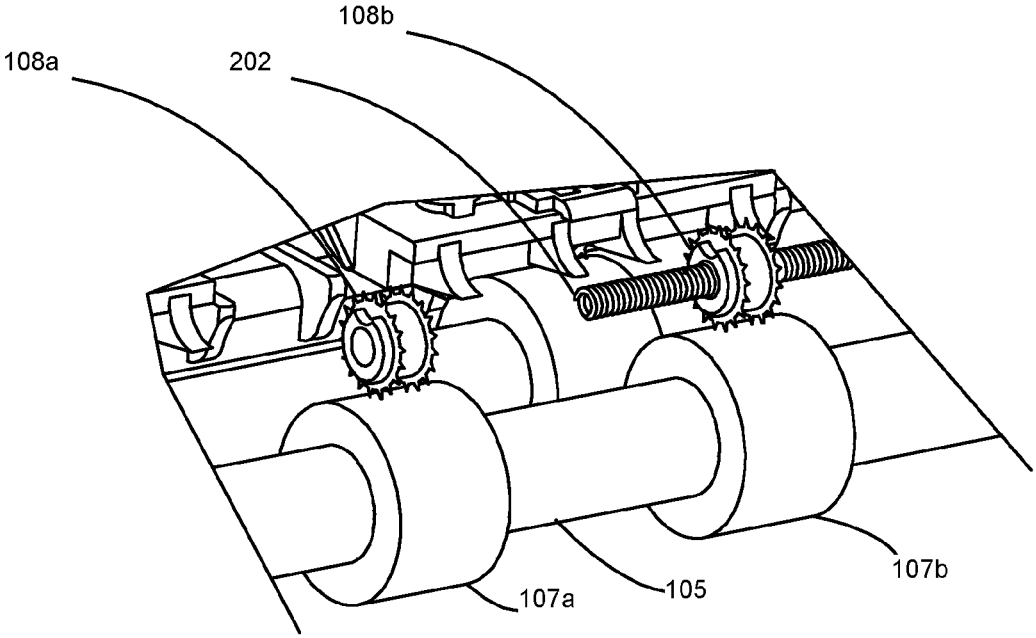
Figure 2 Prior Art
FIG. 2 is a partial enlarged cutaway view of the prior art print media feed system of FIG. 1 showing the star wheels and feed roll.

FIG. 2 shows a drawing of a star wheel pair 108*b* and its spring 202. Spring 202 supports star wheel pair 108*b* and biases star wheel pair 108*b* against roll 107*b*. The supporting structure for spring 202 is not shown for clarity. Spring 202 deflects when media passes between star wheel pair 106*b* and its corresponding roll 107*b*. The biasing force applied by spring 202 is not adjustable and depends on the fixed properties of spring 202. In this system, star wheel 108*b* is either in contact with the roll 107*b* or is in contact with media (not shown). This may create print defects, star wheel wear, etc. as described previously. Star wheel pair 108*a* is shown without its spring.

FIG. 3 shows an example schematic embodiment of a media feed system of the present invention for use in an inkjet printer. Media feed system 300 has a media feed roll 302 and a star wheel 304 forming a feed nip 306 therebetween for receiving a sheet of print media. Star wheel 304 is biased by an adjustable directional biaser 310 that provides in a first position a biasing force to move star wheel 304 toward feed roll 302 and in a second position provides a biasing force to move star wheel 304 away from feed roll 302 with the biasing force changing magnitude and direction as the directional biaser 310 moves between the first and second positions.

Directional biaser 310 includes a lever 312, a spring 314, and a cam 316. Cam 316 is operably coupleable to a motor 318. At a first end 312-1, lever 312 is pivotally mounted to a support 330 provided in the inkjet printer. At a second end 312-2, lever 312 is rotatably coupled to star wheel 304. Spring 314 is operably coupled at a first end 314-1 to lever 312 and at a second end 314-2 to a support 332 provided in the inkjet printer. As cam 316 rotates, lever 312 remains in contact with the cam 316 due to the force of spring 314 acting on lever 312. Lever 312 is made of a flexible material, such as spring steel, so that the lever 312 will flex and apply a variable biasing force to the star wheel 304 as the cam 310 is rotated. The flexed state of lever 312 is shown in dotted lines. The downward-directed force generated by flexing the lever 312 is larger than the upward-directed force generated by the spring 314, resulting in a downward-directed biasing force applied to the star wheel 304. Thus, rotating the cam adjusts the biaser 310 to provide one of a plurality of biasing forces to the star wheel 304 via lever 312, each of the plurality of biasing forces having a unique magnitude, a unique direction, or a unique magnitude and direction.

Cam 316 may be operably coupled to motor 318 in a number of configurations. Cam 316 may in one form be mounted directly on an output shaft 320 of motor 318 at an off-centered position (See FIG. 3A). In another form, a transmission 350, driven by biaser motor 318, is operably coupled between output shaft 320 of motor 318 and a shaft 322 rotatably mounted in the inkjet printer. Cam 316 mounts on shaft 322. In one form transmission 350 is a belt 350 coupled between output shaft 320 of biaser motor 318 and shaft 322.

Biaser motor 318 is in operable communication with a controller 360 via communications link 362 for controlling the operation of biaser motor 318. Biaser motor 318 may be, for example, a stepper motor and controller 360 adjusts the angular position of cam 316 by stepping biaser motor 318 to a given angular position allowing cam 316 to remain at that position. Controller 360 is also shown in operable communication via communications link 364 with feed roll motor 370 that is operably coupled to feed roll 302 for controlling the operation of feed roll 302.

As cam 316 on shaft 322 rotates to a first position of maximum biasing force, lever 312 rotates about its first end 312-1 and support 330 to apply a biasing force to star wheel 304 that is counter to that of spring 314 so that star wheel 304 is driven in a first direction toward feed roll 302. The maximum biasing force applied by lever 312 occurs when major axis 316M of cam 316 would be perpendicular to lever 312. Cam 316 is shown approaching this position in FIG. 3. Cam 316 may have different profiles but is generally elliptical is shape. Increasing the length of major axis 316M of cam 316 will increase the biasing force toward feed roll 302 and toward surface 342 of sheet of media 340, when present. In FIG. 3, star wheel 304 is illustrated touching the printed surface 342 of a sheet of print media 340 with the tips of star wheel 304 slightly penetrating printed surface 342.

In FIG. 4, the angular position of cam 316 has been rotated by biaser motor 318 in a second direction about 90 degrees from that shown in FIG. 3 so that the minor axis 316*m* of cam 316 is approximately perpendicular to lever 312. The biasing force applied by directional biaser 310 is now directing star wheel 304 away from the surface 342 of sheet of media 340 and feed roll 304 due to the force applied by spring 314 to lever 312. In this configuration, the biasing force applied by directional biaser 310 is opposed by the force of gravity acting on star wheel 304. Relative to FIG. 3, cam 316 may be rotated between 90 to 180 degrees to a second position to achieve the reversal of direction and a change in the magnitude of the applied biasing force due to the eccentric positioning of can 316 on shaft 318. With cam 316 being rotated between 90-180 degrees there is less distance between shaft 322 and lever 312. Spring 314 contracts, causing lever 312 to pivot about support 330, lifting star wheel 304. This biasing position is useful, for example, to lift star wheel 304 to avoid contacting ink pooled in an area of heavy printing on the surface 342 of print media 340.

It will be realized that as cam 316 is rotated between a first position where its major axis 316M is approximately perpendicular to lever 312 and a second position where its minor axis 316*m* is approximately perpendicular to lever 312, the magnitude and direction of the biasing force applied to star wheel 304 can be varied and that the height of nip 306 can also be controllably varied. In other words as the angular position of cam 316 changes and thus the biasing force applied to star wheel 304 via lever 312 changes, one of a plurality of biasing forces is applied dependent on the angular position of cam 316. Thus, directional biaser 310 can be used to vary the force that star wheel 304 applies to a sheet of media when present in nip 306. It may also be used to adjust the height of nip 306 to accommodate thicker media or to move star wheel 304 away from contact with feed roll 302.

The biasing force of adjustable directional biaser 310 may be adjusted to optimize the media feed system in response to different media properties. For example, a stronger biasing force on star wheel 304 may be used when feeding thin media than when feeding thicker card stock. Also, the biasing force may be reduced when feeding photo media to avoid the tips of star wheel 304 making print-defect divots in the surface 342 of the sheet of media 340.

Figure 7:
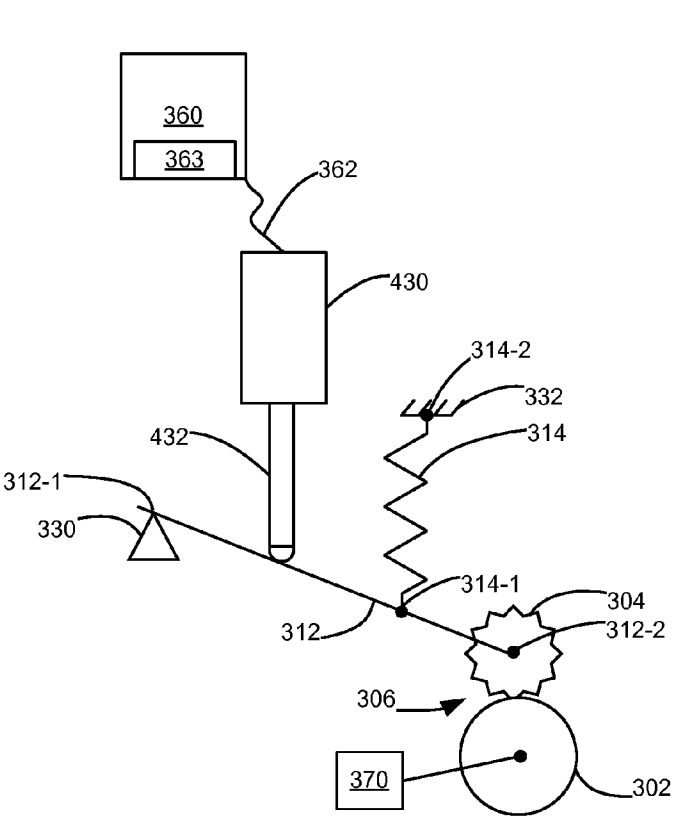
FIG. 7 is a still further form of the star wheel biaser of FIG. 3 with the biaser motor and cam replaced by a solenoid acting on the lever.
Figure 6:
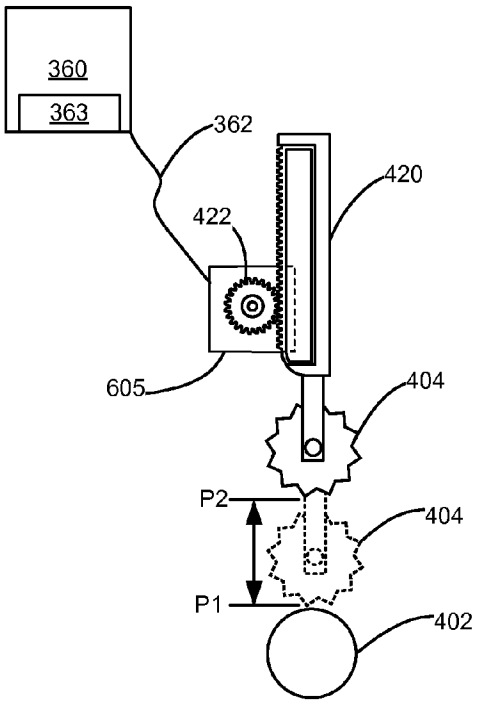
FIG. 6 is a further form of the star wheel biaser using a rack and pinion to apply a biasing force to the star wheel.
Figure 5:
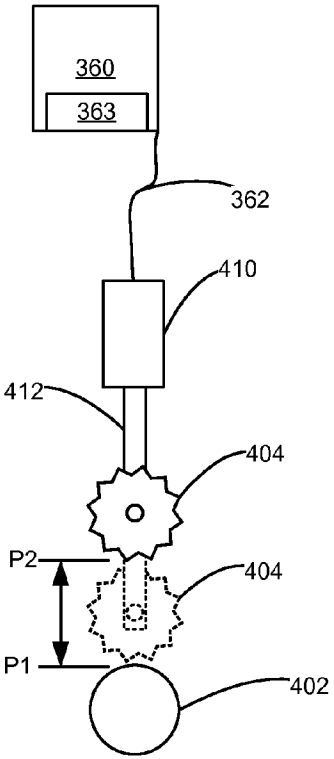
FIG. 5 is another form of the star wheel biaser using a solenoid having the star wheel attached.

Other adjustable directional biasers are contemplated. For example, in FIG. 5 a star wheel 404 may be rotatably mounted to a shaft 412 of solenoid 410 which may apply a plurality of biasing forces depending on whether the solenoid 410 is energized or de-energized moving star wheel 404 with respect to feed roll 402 as indicated by the arrow between a first position P1 indicated by the dotted lines to a second position P2 away from feed roll 402. Controller 360 is operatively coupled via communication link 362 to the solenoid 410 to energize or de-energize the solenoid 410. In another form illustrated in FIG. 6, star wheel 404 may be rotatably mounted to a rack 420 driven by a pinion gear 422 that is operably coupleable to a biaser motor 605, that is operable communication via communication link 362 to controller 360, such that operation of biaser motor 605 rotates pinion gear 422 to apply a plurality of biasing forces to star wheel 404. Again rack 420 would translate as indicated by the arrow, moving star wheel 404 between the first position P1 and the second positions P2, as indicated by the arrow, with respect to feed roll 402. The first position P1 is adjacent to or in contact with feed roll 402 and second position P2 is spaced away from feed roll 402. In a still further form shown in FIG. 7, the biaser motor 318 and cam 316 of FIG. 3 have been replaced by a solenoid 430. Controller 360 is in operable communication via communication link 362 to the solenoid 430. The shaft 432 of solenoid 430 is in contact with lever 312. Solenoid 430 in combination with biasing member 314 may apply a plurality of biasing forces depending on whether the solenoid 430 is energized or de-energized moving star wheel 304 between a first position as shown adjacent feed roll 302 to a second position spaced away from feed roll 302.

Figure 8:
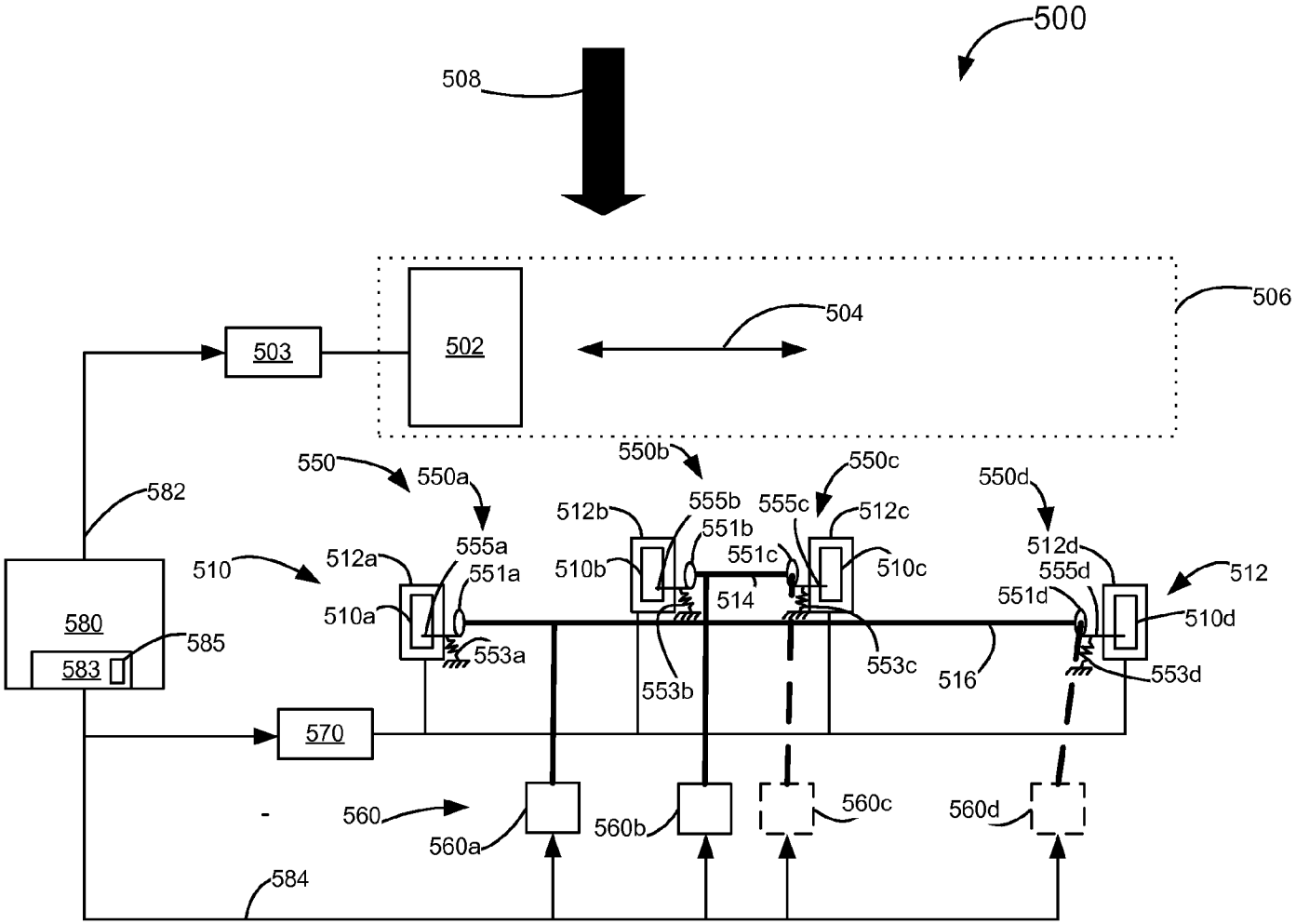
FIG. 8 is a schematic diagram of one example embodiment of a print media feed system with nested star wheels.

FIG. 8 shows an example embodiment of a inkjet printer of the present invention. The inkjet printer 500 includes a printhead 502 which is operably coupled to motor 503 to reciprocate in a printhead travel direction 504 within a printing region 506. Media is fed in a media feed direction that is parallel to the plane of the page and indicated by arrow 508. The media is fed beneath printhead 502 to a plurality of star wheels, generally designated 510, and a corresponding plurality of feed rolls, generally designated 512, located downstream from the printhead 502. A plurality of adjustable directional biasers, generally designated 550, is provided. Directional biasers 550 are configured substantially the same as directional biaser 310 having a cam, generally designated 551, a biasing member, generally designated 553, such as spring 553, and a lever, generally designated 555. For brevity, the details of operation thereof will not be repeated. Biaser motors, generally designated 560, are operatively coupleable to directional biasers 550. Printhead 502 and biaser motors 560 and feed roll motor 570 are communicatively coupled to and controlled by controller 580 via communication links 582, 584, respectively. Fours sets of star wheels 510, directional biasers 550 are shown but this should not be construed to be limiting. The number of star wheels and directional biasers is a matter of design choice.

Each star wheel 510*a*-510*d* has a corresponding media feed roll 512*a*-512*d*, respectively. Star wheels 510*a*, 510*d* are biased by adjustable directional biasers 550*a*, 550*b* while stars wheels 510*b*, 510*c* are biased by adjustable directional biasers 550*c*, 550*d*, respectively. Directional biasers 550*a*-550*d* each comprise cams 551*a*-551*d*, springs 553*a*-553*d*, and levers 555*a*-555*d*, respectively, that function and are cooperatively engaged as previously described. The innermost star wheels 510*b*, 510*c* and corresponding feed rolls 512*b*, 512*c* are nested between the outermost star wheels 510*a*, 501*d* and corresponding feed rolls 512*a*, 512*d* as viewed perpendicular to the media feed path 508. Cams 551*b*, 551*c* for the innermost star wheels 510*b*, 510*c* are driven by a common shaft 514 by biaser motor 560*b* which allows for concurrent adjustment to the biasing forces applied to the innermost star wheels 510*b*, 510*c*. Cams 551*a*, 551*d* for the outermost star wheels 510*a*, 510*d* are driven by a second common shaft 516 by biaser motor 560*a* which again allows for the concurrent adjustment of the biasing forces applied to outer star wheels 510*a*, 510*d*.

When printing narrow media, for example, the innermost star wheels 510*b*, 510*c* may be biased by biaser 550*b* so that they pinch the sheet of media against their corresponding media feed rolls 512*b*, 512*c* to assist in feeding the sheet of media in the media feed direction 508. At the same time, the outermost star wheels 510*a*, 510*d* may be biased by biasers 550*a*, 550*d* so that they lift off of their corresponding media feed rolls 512*a*, 512*d* to avoid unnecessary wear on the star wheels 510*a*, 510*b*. When printing a sheet of wider media, all of the star wheels 510*a*-510*d* may be biased to touch the wider media.

Of course, inkjet printer 500 may be designed such that the biasing force applied to each star wheel 510*a*-510*d* is independently controlled as indicated by optional biaser motors 560*c*, and 560*d* shown in dashed lines. Shafts 514, 516 would not be installed with such an arrangement and biaser motors 560*c*, 560*d* would be operatively coupled to respective cams 551*c*, 551*d* as indicated by the dashed line. Controller 580 would control optional biaser motors 560*c*, 560*d* via communication link 584.

Controllers 360, 580 may be formed, for example, as an application specific integrated circuit (ASIC), and may include a processor, such as a microprocessor, and associated memory 363, 583. Memory 363, 583 may be any volatile or non-volatile memory of combination thereof such as, for example, random access memory (RAM), read only memory (ROM), flash memory and/or non-volatile RAM (NVRAM). Alternatively, memory 363, 583 may be in the form of a separate electronic memory (e.g., RAM, ROM, and/or NVRAM), a hard drive, a CD or DVD drive, or any memory device convenient for use with controllers 360, 580. Memory 363, 583 may be used to store program instructions for controllers 360, 580 to control biaser motors 560*a*-560*d* and their corresponding directional biasers 550*a*-550*d*. Look up tables 365, 585 may be provided in memories 363, 583, respectively. Look up tables 365, 585 may store biaser positions corresponding to provide biasing forces dependent on the media thickness, media stiffness, print density, as well as default biasing positions.

As used herein, the term "communications link" generally refers to structure that facilitates electronic communication between two components, and may operate using wired or wireless technology. Accordingly, communications links may be a direct electrical wired connection, a direct wireless connection (e.g., infrared or r.f.), or a network connection (wired or wireless), such as for example, an Ethernet local area network (LAN) or a wireless networking standard, such as IEEE 802.11. Although separate communications links are shown between controller 360, 580 and the other controlled elements, a single communication link can be used to communicatively couple the controller 360, 580 to all of the controlled elements for example controller 580 to such as motor 503, feed motor 570, biaser motors 560, etc.

Figure 9:
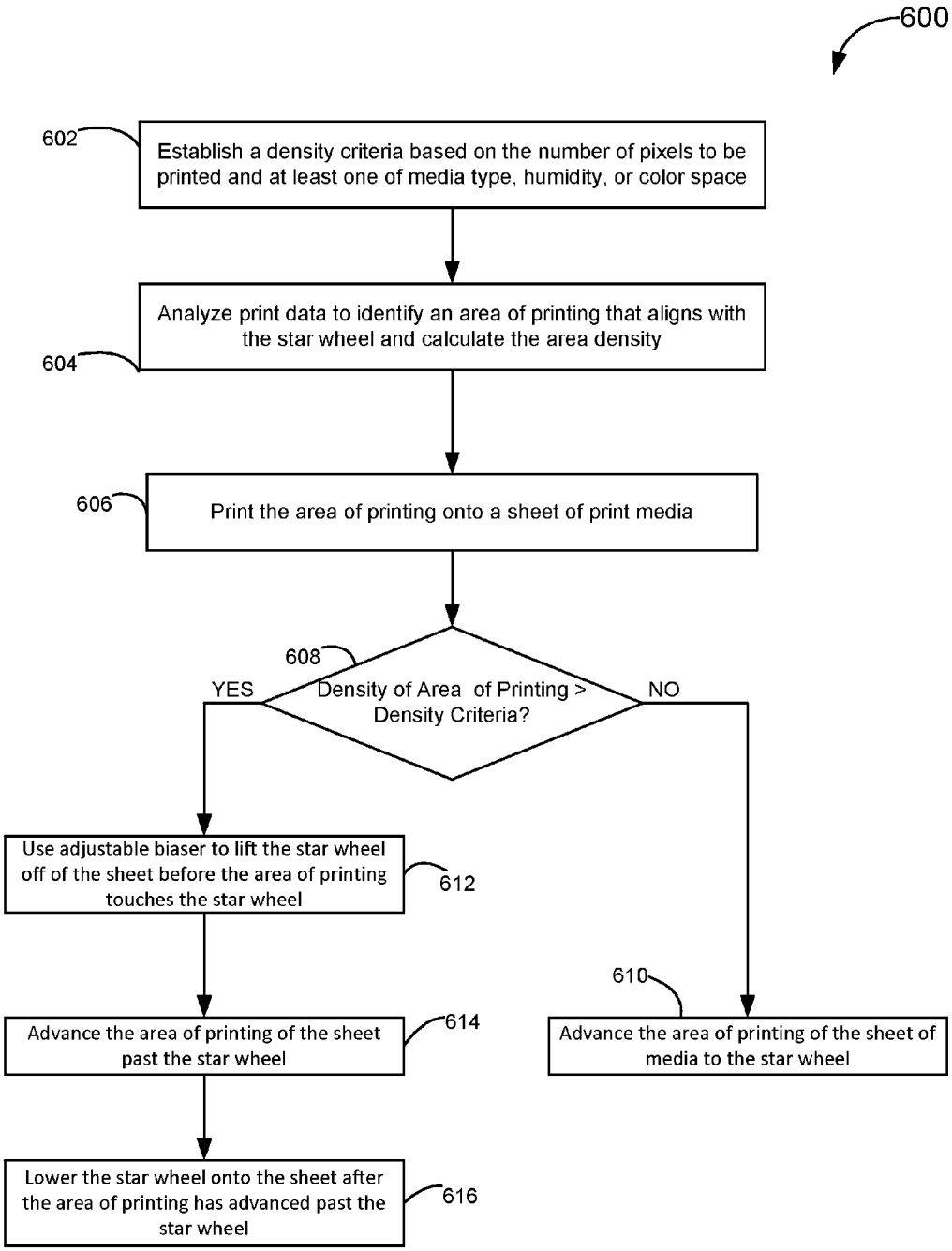
FIG. 9 is a flowchart of a method of printing with an inkjet printer in accordance with the present invention.

FIG. 9 shows an example embodiment of a method of printing using the present invention. The method of printing 600 minimizes the amount of wet ink that a star wheel contacts to minimize ink buildup on the star wheel. This helps to reduce the amount of print defects caused by ink transferring from the star wheel to the media. The method utilizes star wheels that have an adjustable biaser. As previously described, adjusting an adjustable biaser may include, for example, rotating a motor coupled to the adjustable biaser to adjust a biasing force applied by the adjustable biaser to the star wheel; changing the angular position of a cam located within the adjustable biaser to adjust a biasing force applied by the adjustable biaser to the star wheel; rotating a pinion gear coupled to a rack located within the adjustable biaser to adjust the position of the star wheel; and energizing a solenoid located within the adjustable biaser to adjust a biasing force applied by the adjustable biaser to the star wheel.

At block 602, the method 600 establishes a density criteria based upon the number of pixel to be printed and at least one of media type, humidity or color space An example density criteria is the number of pixels to be printed within a given area. Since plain paper is somewhat absorptive, printing must be relatively dense before ink will remain on the surface long enough to touch the star wheel. In contrast, photo paper is much less absorptive and printing may be less dense and still cause star wheel contamination. Humidity and color space may also influence the density required to cause star wheel contamination.

At block 604 the method 600 analyzes print data to identify an area of printing that aligns with the star wheel and calculates the area density.

At block 606, the method 600 prints the area of printing onto a sheet of print media.

At block 608, a determination is made to see if the area density exceeds the density criteria. If NO, the area density is less than the density criteria, method 600 proceeds to block 610 where the area of printing of the sheet of media is advanced to the star wheels. Because the area density is less than the density criteria, the need to lift the star wheels for the printed area is not needed as there is little likelihood of contamination of the star wheel. If YES, the area density exceeds the density criteria and star wheel contamination is a concern, the method 600 proceeds to block 612.

At block 612 the method 600 uses the adjustable biaser to lift the star wheel off of the sheet of media before the area of printing touches the star wheel. At block 614 the method 600 advances the area of printing of the sheet past the star wheel. At block 616, the star wheel is lowered back onto the sheet by the biaser after the area of printing has advanced past the star wheel.

Figure 10:
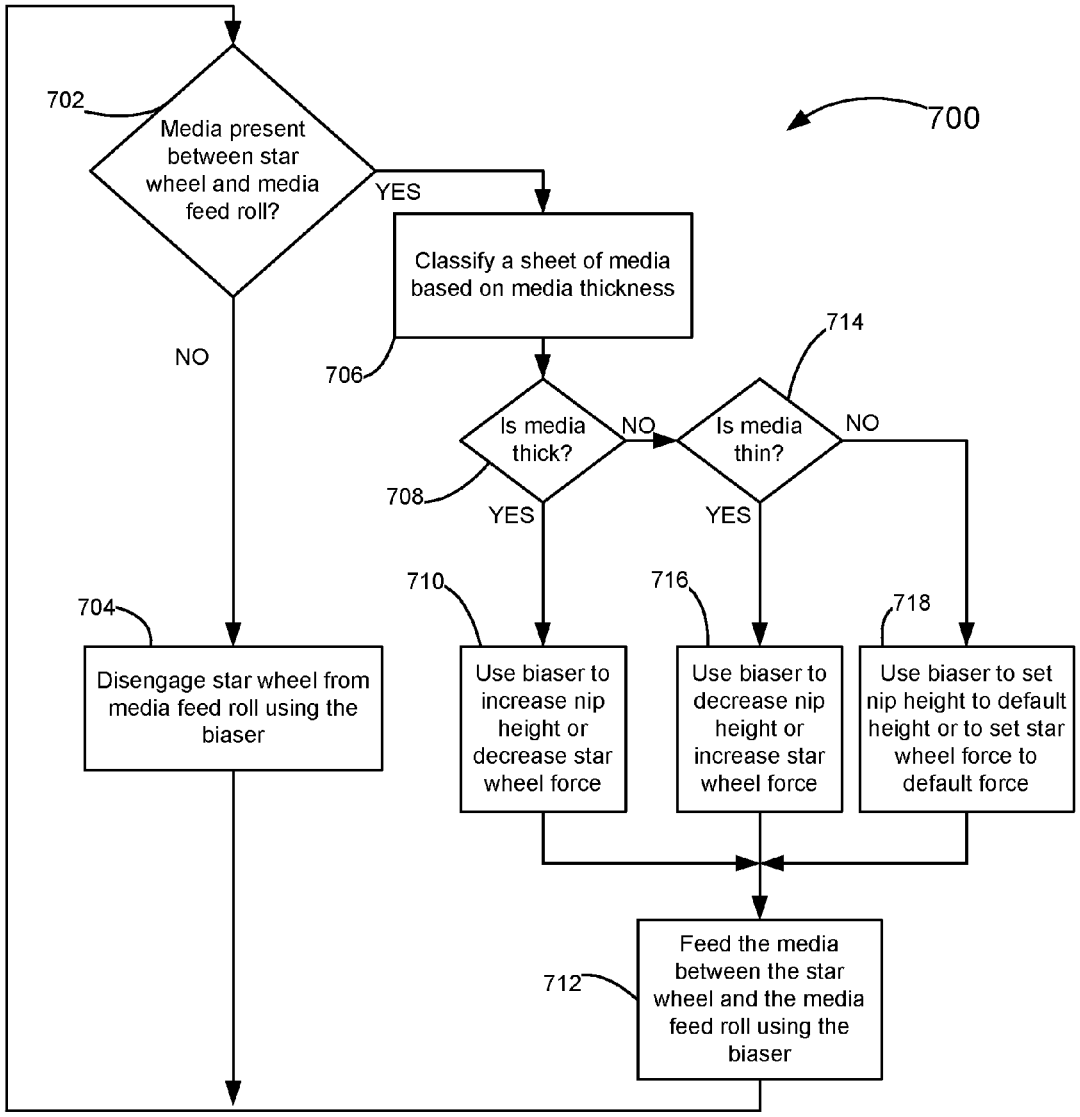
FIG. 10 is a flowchart of a method of feeding media in a inkjet printer in accordance with the present invention.

FIG. 10 shows an example embodiment of a method of feeding media in a inkjet printer 700. At block 702, a determination is made to see if media is present between a star wheel and a media feed roll. This determination may be done by a media sensor placed in proximity to the star wheel or by counting the number of line feeds done on the media by a media feed stepper motor from an input feed roll because the distance between the input feed roll and the star wheel is known and can be converted into an equivalent number of lines feeds. If NO, media is not present, method 700 proceeds to block 704 where method 700 uses a biaser to disengage the star wheel from the media feed roll. If YES, media is present, method 700 proceeds to block 706.

At block 706, method 700 determines a classification of a sheet of media based on media thickness. The determination may be made, for example, based on a user selection of media thickness, a measurement of media thickness, a measurement of media stiffness, etc. At block 708, a determination is made to see if the media is thick. If YES, the media is thick, method 700 proceeds to block 710 where the method 700 uses a biaser to increase nip height or decrease star wheel force. The amount of increase or decrease may be found by controller 360 in a look up table in memory 601 based upon the media thickness. At block 712, method 700 clamps the media between the star wheel and the media feed roll. If NO, media is not thick, method 700 proceeds to block 714 where a determination is made to see if the media is thin. If YES, media is thin, method 700 proceeds to block 716 where method 700 uses a biaser to decrease nip height or increase star wheel force then proceeds to block 712. Again the amount of increase or decrease may be found by controller 360 in a look up table in memory 601 based upon the media thinness. If NO, media is not thin, method 700 proceeds to block 718 where method 700 uses a biaser to set nip height to default height or to set star wheel force to default force then proceeds to block 712. The default height may be stored in memory 601. This method may be used, for example, to prevent wearing the star wheel against a rotating media feed roll when media is not present. This method may also be used, for example, to improve paper feeding across a range of media thicknesses.

The foregoing description of several embodiments of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A print media feed system in an inkjet printer, said system comprising:

a feed roll;

a first adjustable biaser comprising:

a first star wheel mounted opposing the feed roll forming a nip therebetween for receiving a sheet of media;

a first lever having a first end pivotally mounted in the inkjet printer and a second end rotatably coupled to the first star wheel;

a first motor;

a first cam having an elliptical shape having a major axis, the first cam operably coupleable to the first motor at an off-center position on the major axis of the first cam; and a first biasing member holding the first lever against the first cam; and, a controller communicatively coupled to the first motor, the controller being configured to adjust the angular position of the first motor to adjust the angular position of the first cam, wherein, with the first cam having an angular position where the major axis is substantially parallel to the first lever, a biasing force on the first star wheel is directed away from the feed roll separating the first star wheel and the feed roll, and as the angular position of first cam changes during rotation and the major axis of the first cam changes away from being substantially parallel to the first lever, and first star wheel moves into contact with the feed roll and the sheet of media with first lever member being in an unflexed position with the biasing force on the first star wheel being directed toward the feed roll and sheet of media and increasing to a substantially maximum biasing force being directed toward the feed roll and the sheet of media when the major axis of the cam is perpendicular to the lever arm.

2. The print media feed system of claim 1 wherein the first lever is in a flexed position when the maximum biasing force occurs.

3. The print media feed system of claim 1 wherein the first lever is made of spring steel.

4. The print media feed system of claim 1 wherein the first biasing member is a spring having one end mounted to the first lever and the other end mounted in the ink jet printer.

5. The print media feed system of claim 4 wherein the first cam is positioned between the first end of the first lever and the spring.

6. The print media feed system of claim 1, further comprising:

a second adjustable biaser comprising:

a second star wheel mounted opposing the feed roll forming a nip therebetween for receiving the sheet of media;

a second lever having a first end pivotally mounted in the inkjet printer and a second end rotatably coupled to the second star wheel;

a second motor;

a second cam having an elliptical shape having a major axis, the second cam operably coupled to the second motor at an off-center position on the major axis of the second cam, and a second biasing member holding the second lever against the second cam; and, the controller being in operable communication with the second motor, wherein, operation of the second motor by the controller controls the angular positioning of the second cam and second lever in substantially the same manner as the first adjustable biaser, and, further wherein, the controller independently controls the first and second motors to vary the rotation of the first and second cams, respectively, thereby varying the biasing force applied to each of the first and second star wheels via the first and second levers, respectively.

7. The print media feed system of claim 6 wherein the first lever and second lever are each in a flexed positioned when the respective maximum biasing forces occur.

8. The print media feed system of claim 6 wherein the first lever and second lever are made of spring steel.

9. The print media feed system of claim 6 wherein the first biasing member is a first spring having one end mounted to the first lever and the other end mounted in the ink jet printer and the second biasing member is a second spring having one end mounted to the second lever and the other end mounted in the ink jet printer.

10. The print media feed system of claim 9 wherein the first cam is positioned between the first end of the first lever and the first spring and the second cam is positioned between the first end of the second lever and the second spring.

11. The print media feed system of claim 6, further comprising:

a third adjustable biaser comprising:

a third star wheel mounted opposing the feed roll forming a nip therebetween for receiving the sheet of media;

a third lever having a first end pivotally mounted in the inkjet printer and a second end rotatably coupled to the third star wheel;

a third cam having an elliptical shape having a major axis, and a third biasing member holding the third lever against the third cam;

a fourth adjustable biaser comprising:

a fourth star wheel mounted opposing the feed roll forming a nip therebetween for receiving the sheet of media;

a fourth lever having a first end pivotally mounted in the inkjet printer and a second end rotatably coupled to the fourth star wheel;

a fourth cam having an elliptical shape having a major axis, and a third biasing member holding the third lever against the third cam;

a first shaft operably coupled to the first motor, the first shaft having the first and third cams operably coupled thereto at respective off-center positions on the respective major axes thereof wherein operation of the first motor by the controller operates the first and third adjustable biasers in substantially the same manner as the first adjustable biaser to rotate the first shaft and the first and third cams concurrently to adjust the biasing forces applied to the first and third star wheels via the first and third levers, respectively; and a second shaft operably coupled to the second motor, the second shaft having the second and fourth cams operably coupled thereto at respective off-center positions on the respective major axes thereof wherein the second and fourth star wheels are nested between the first and third star wheels and the controller operates the second and fourth adjustable biasers in substantially the same manner as the first adjustable biaser to rotate the second shaft and the second and fourth cams concurrently to adjust the biasing forces applied to the second and fourth star wheels via the second and fourth levers, respectively;

wherein the controller controls the first and second motors to vary the operation of the first and third adjustable biasers independently of the operation of the second and fourth adjustable biasers, respectively, thereby varying the biasing force applied to each of the first and third star wheels via the first and third levers, respectively, from the biasing force applied to the second and fourth star wheels via the second and fourth levers, respectively.

12. The print media feed system of claim 11 wherein the third lever and fourth lever are each in a flexed position when the respective maximum biasing forces occur.

13. The print media feed system of claim 11 wherein the third lever and fourth lever are made of spring steel.

14. The print media feed system of claim 11 wherein the third biasing member is a third spring having one end mounted to the third lever and the other end mounted in the ink jet printer and the fourth biasing member is a fourth spring having one end mounted to the fourth lever and the other end mounted in the ink jet printer and wherein the third cam is positioned between the first end of the third lever and the third spring and the fourth cam is positioned between the first end of the fourth lever and the fourth spring.

* * * * *